US009585464B2

(12) United States Patent
Moskovich et al.

(10) Patent No.: US 9,585,464 B2
(45) Date of Patent: Mar. 7, 2017

(54) ORAL CARE IMPLEMENT

(75) Inventors: Robert Moskovich, East Brunswick, NJ (US); Andreas Wechsler, Zell am See (AT); Michael Rooney, Millburn, NJ (US); Douglas Hohlbein, Hopewell, NJ (US)

(73) Assignee: COLGATE-PALMOLIVE COMPANY, New York, NY (US)

( * ) Notice: Subject to any disclaimer, the term of this patent is extended or adjusted under 35 U.S.C. 154(b) by 277 days.

(21) Appl. No.: 14/381,008

(22) PCT Filed: Mar. 1, 2012

(86) PCT No.: PCT/US2012/027163

§ 371 (c)(1),
(2), (4) Date: Aug. 26, 2014

(87) PCT Pub. No.: WO2013/130079

PCT Pub. Date: Sep. 6, 2013

(65) Prior Publication Data

US 2015/0164208 A1 Jun. 18, 2015

(51) Int. Cl.
*A46B 7/06* (2006.01)
*A46B 9/04* (2006.01)
(Continued)

(52) U.S. Cl.
CPC ..... *A46B 7/06* (2013.01); *A46B 5/0025* (2013.01); *A46B 9/04* (2013.01); *A46B 15/0081* (2013.01); *A46B 2200/1066* (2013.01)

(58) Field of Classification Search
CPC ..... A46B 7/02; A46B 7/06
(Continued)

(56) References Cited

U.S. PATENT DOCUMENTS 2,263,802 A 5/1939 Grusin
3,398,421 A 3/1967 Rashbaum
(Continued)

FOREIGN PATENT DOCUMENTS

CA 2618892 2/2004
CN 2585581 11/2003
(Continued)

OTHER PUBLICATIONS

International Search Report and the Written Opinion issued in International Application PCT/US2012/27163 mailed Jan. 4, 2013. WO.

(Continued)

*Primary Examiner* — Mark Spisich

(57) ABSTRACT

An oral care implement having a head that achieves an enhanced cleaning action during brushing. In one embodiment, the invention can be an oral care implement comprising: a handle; a head connected to the handle, the head comprising a base structure having a front surface and an opening in the front surface; a carrier having a front surface and a rear surface, the carrier comprising a plurality of teeth cleaning elements extending from the front surface, the carrier movably supported above the front surface of the base structure so that a gap exists between the rear surface of the carrier and the front surface of the base structure; and a spheroid positioned within the opening so that a first portion of the spheroid protrudes from the front surface of the head into the gap and alters movement of the carrier relative to the head.

24 Claims, 6 Drawing Sheets

(51) Int. Cl.
*A46B 5/00* (2006.01)
*A46B 15/00* (2006.01)

(58) Field of Classification Search
USPC ..... 15/201
See application file for complete search history.

(56) References Cited

U.S. PATENT DOCUMENTS

| | | | |
|---|---|---|---|
| 5,524,319 | A | 6/1996 | Avidor |
| 5,802,656 | A | 9/1998 | Dawson et al. |
| 5,956,797 | A | 9/1999 | Wilson |
| 6,408,473 | B1 | 6/2002 | Kessler |
| 7,480,955 | B2 | 1/2009 | Hohlbein et al. |
| 7,614,111 | B2 | 11/2009 | Moskovich et al. |
| 7,841,041 | B2 | 11/2010 | Moskovich et al. |
| 2004/0025274 | A1 | 2/2004 | Moskvich et al. |
| 2005/0000049 | A1 | 1/2005 | Hohlbein |
| 2006/0010628 | A1 | 1/2006 | Moskovich |
| 2006/0195995 | A1 | 9/2006 | Moskovich et al. |
| 2008/0086827 | A1 | 4/2008 | Waguespack et al. |
| 2008/0147104 | A1 | 6/2008 | Gatzemeyer et al. |
| 2009/0025165 | A1 | 1/2009 | Moskovich et al. |
| 2010/0092916 | A1 | 4/2010 | Teixeira et al. |
| 2011/0138563 | A1 | 6/2011 | Phgura |
| 2011/0152909 | A1 | 6/2011 | Jimenez et al. |

FOREIGN PATENT DOCUMENTS

| | | |
|---|---|---|
| CN | 2738619 | 11/2005 |
| DE | 20109123 U1 | 10/2002 |
| DE | 202005009026 U1 | 11/2005 |
| DE | 102006025825 A1 | 12/2007 |
| JP | H11253231 | 9/1999 |
| WO | WO 2004/019801 | 3/2004 |
| WO | WO 2007/051203 A1 | 5/2007 |
| WO | WO 2008/093300 A1 | 8/2008 |
| WO | WO 2008/103597 A1 | 8/2008 |
| WO | WO 2009/157932 | 12/2009 |

OTHER PUBLICATIONS

Written Opinion of the International Preliminary Examining Authority issued in International Application PCT/US2012/27163 mailed Feb. 21, 2014. WO.

ORAL CARE IMPLEMENT

CROSS-REFERENCE TO RELATED PATENT APPLICATIONS

The present application is a U.S. national stage entry under 35 U.S.C. §371 of Patent Cooperation Treaty Patent Application No. PCT/US2012/27163, filed Mar. 1, 2012, the entirety of which is incorporated herein by reference.

FIELD OF THE INVENTION

The present invention relates generally to oral care implements, and specifically to oral care implements, such as toothbrushes, having a head that achieves an enhanced cleaning action during brushing.

BACKGROUND OF THE INVENTION

A variety of toothbrush head configurations exist that have manually and/or mechanically-driven movable cleaning elements. Many of these configurations, however, include cleaning elements that extend from a rigid head. Teeth and gums by nature have a complex intricate contour. Due to the rigid nature of the attachment of the cleaning elements to the head of the toothbrush, the orientation of the cleaning elements is not flexible. Thus, a need exists for a toothbrush that achieves better flexibility of cleaning elements for an enhanced and improved cleaning action during brushing.

BRIEF SUMMARY OF THE INVENTION

The present invention is directed to an oral care implement. In one aspect, the oral care implement can include a handle and a head comprising a base structure. A carrier is connected to the base structure of the head so that a gap exists between the carrier and the base structure. The base structure comprises an opening within which a spheroid is positioned. A first portion of the spheroid protrudes from the front surface of the base structure into the gap to alter movement of the carrier relative to the head.

In one embodiment, the invention can be an oral care implement comprising: a handle; a head connected to the handle, the head comprising a base structure having a front surface, a rear surface and an opening forming a passageway extending from the rear surface of the base structure to the front surface of the base structure; a first pod extending from the front surface of the base structure; a carrier having a front surface and a rear surface, the carrier comprising a plurality of teeth cleaning elements extending from the front surface of the carrier, the carrier movably supported above the front surface of the base structure by at least the first pod so that a gap exists between the rear surface of the carrier and the front surface of the base structure; and a spheroid positioned within the opening so that a first portion of the spheroid protrudes from the front surface of the head into the gap and a second portion of the spheroid is visible from the rear surface of the base structure.

In another embodiment, the invention can be an oral care implement comprising: a handle; a head connected to the handle, the head comprising a base structure having a front surface, a rear surface and an opening forming a passageway extending from the rear surface of the base structure to the front surface of the base structure; a carrier having a front surface and a rear surface, the carrier comprising a plurality of teeth cleaning elements extending from the front surface of the carrier, the carrier movably supported above the front surface of the base structure so that a gap exists between the rear surface of the carrier and the front surface of the base structure; and a spheroid positioned within the opening so that a first portion of the spheroid protrudes from the front surface of the head into the gap and a second portion of the spheroid is visible from the rear surface of the base structure.

In a further embodiment, the invention can be an oral care implement comprising: a handle; a head connected to the handle, the head comprising a base structure having a front surface, a rear surface, a basin formed in the rear surface, an upstanding sidewall extending from the floor of the basin that defines an island in the basin, and an opening forming a passageway extending from the front surface of the base structure to the island; a resilient soft tissue cleanser in the basin; a carrier having a front surface and a rear surface, the carrier comprising a plurality of teeth cleaning elements extending from the front surface of the carrier, the carrier movably supported above the front surface of the base structure so that a gap exists between the rear surface of the carrier and the front surface of the base structure; and a mass of resilient material positioned within the opening so that a first portion of the mass protrudes from the front surface of the head into the gap and a second portion of the mass protrudes from the island.

In a still further embodiment, the invention can be an oral care implement comprising: a handle; a head connected to the handle, the head comprising a base structure having a front surface and an opening in the front surface; a carrier having a front surface and a rear surface, the carrier comprising a plurality of teeth cleaning elements extending from the front surface of the carrier, the carrier movably supported above the front surface of the base structure so that a gap exists between the rear surface of the carrier and the front surface of the base structure; and a spheroid positioned within the opening so that a first portion of the spheroid protrudes from the front surface of the head into the gap and alters movement of the carrier relative to the head through surface contact with the rear surface of the carrier.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figure 2:
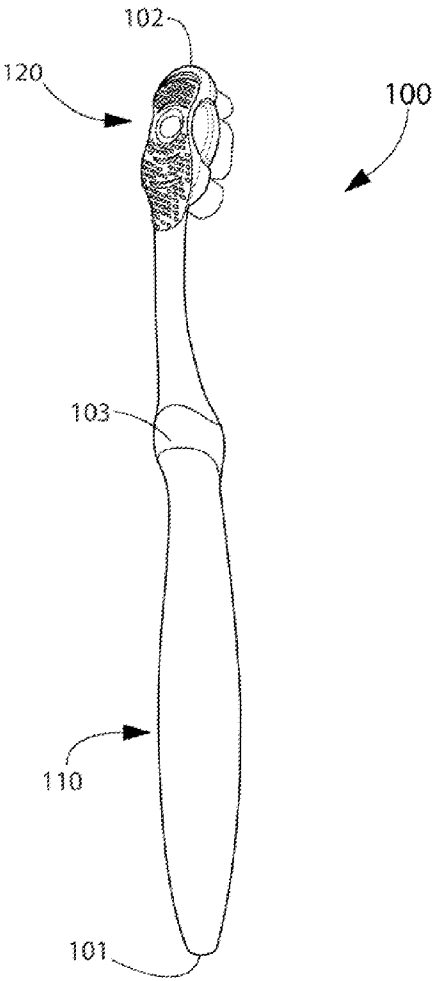
FIG. 2 is a rear perspective view of the oral care implement of FIG. 1.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of the exemplary embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "left," "right," "top," "bottom," "front" and "rear" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," "secured" and similar refer to a relationship wherein structures are secured or attached to one another either directly or indirectly through intervening structures, as well as both movable or rigid attachments or relationships, unless expressly described otherwise. Moreover, the features and benefits of the invention are described by reference to the exemplary embodiments illustrated herein. Accordingly, the invention expressly should not be limited to such exemplary embodiments, even if indicated as being preferred. The discussion herein describes and illustrates some possible non-limiting combinations of features that may exist alone or in other combinations of features. The scope of the invention is defined by the claims appended hereto.

Figure 1:
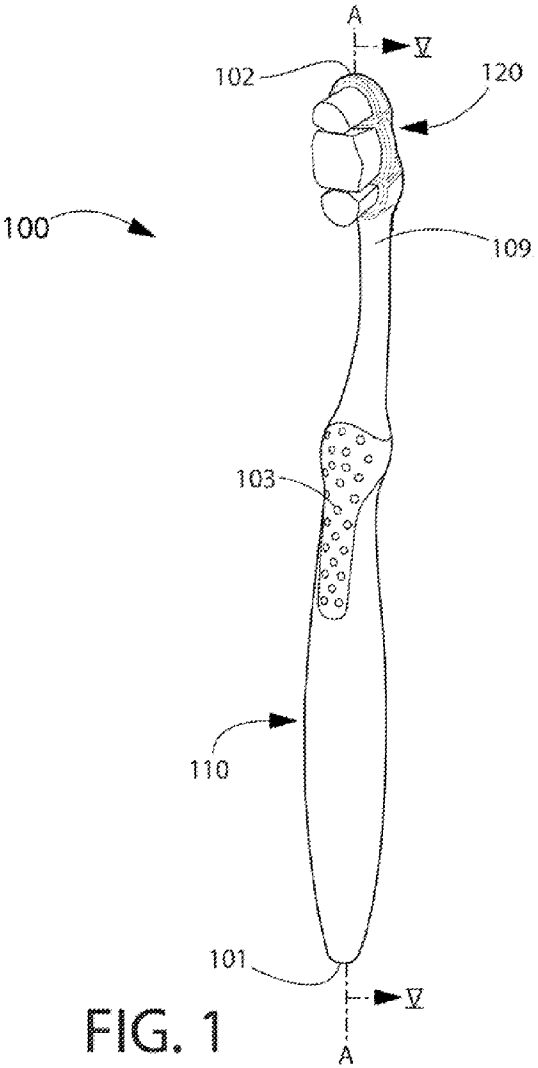
FIG. 1 is a front perspective view of an oral care implement in accordance with a first embodiment of the present invention.

Referring first to FIGS. 1 and 2 concurrently, an oral care implement 100 in accordance with an embodiment of the present invention will be described. In the exemplified embodiment, the oral care implement 100 is in the form of a manual toothbrush. However, in certain other embodiments the oral care implement 100 can take on other forms such as being a powered toothbrush, a tongue scraper, a gum and soft tissue cleaner, a water pick, an interdental device, a tooth polisher, a specially designed ansate implement having tooth engaging elements or any other type of implement that is commonly used for oral care. Thus, it is to be understood that the inventive concepts discussed herein can be applied to any type of oral care implement unless a specific type of oral care implement is specified in the claims.

The oral care implement 100 extends along a longitudinal axis A-A from a proximal end 101 to a distal end 102. The oral care implement 100 generally comprises a handle 110 and a head 120. The handle 110 is an elongated structure that provides the mechanism by which the user can hold and manipulate the oral care implement 100 during use. The handle 110 can take on a wide variety of shapes, contours and configurations, none of which are limiting of the present invention. In the exemplified embodiment, the handle 110 is formed of a hard plastic material, such as for example without limitation polypropylene, polymers and copolymers of ethylene, propylene, butadiene, vinyl compounds and polyesters such as polyethylene terephthalate. Of course, the invention is not to be so limited in all embodiments and the handle 110 may be formed with a resilient material, such as a thermoplastic elastomer, over portions of or the entirety of the handle 110 to enhance the gripability of the handle 110 during use. In the exemplified embodiment, the handle 110 comprises a resilient material 103 in the thumb grip region. Thus, the resilient material 103 is in the region of the handle 110 that will be gripped by a user's thumb and forefinger during use of the oral care implement 100.

The head 120 is coupled to a distal end 109 of the handle 110. In the exemplified embodiment, the head 120 and the handle 110 are integrally formed as a single unitary structure using a molding, milling, machining or other suitable process. However, in other embodiments the handle 110 and the head 120 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. Whether the head 120 and the handle 110 are of a unitary or multi-piece construction (including connection techniques) is not limiting of the present invention, unless specifically claimed. In some embodiments of the invention, the head 120 may be detachable (and replaceable) from the handle 110 using techniques known in the art.

Figure 3B:
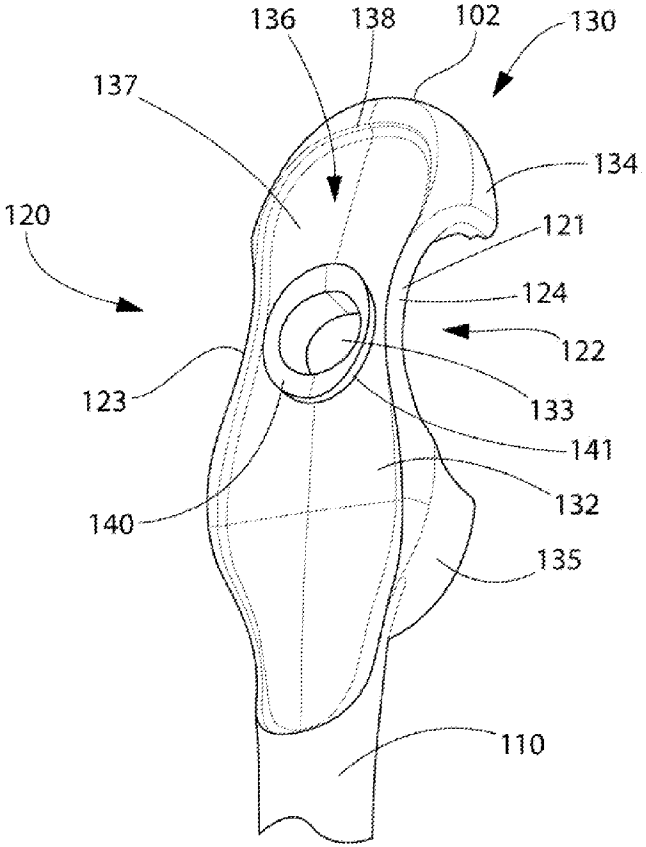
FIG. 3B is a rear perspective view of the base structure of the head of the oral care implement of FIG. 1.
Figure 3A:
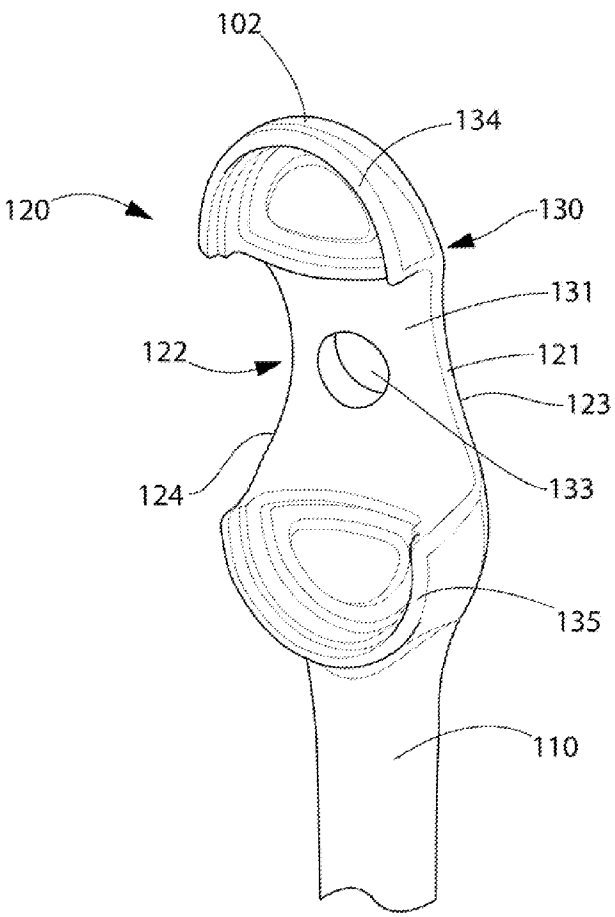
FIG. 3A is a front perspective view of the base structure of the head of the oral care implement of FIG. 1.

Referring to FIGS. 3A and 3B concurrently, the head 120 will be described in more detail. The head 120 of the oral care implement 100 generally comprises a base structure 130 having a front surface 131, an opposing rear surface 132 and an opening 133 extending therethrough. The opening 133 forms a passageway through the base structure 130 that extends from the rear surface 132 of the base structure 130 to the front surface 131 of the base structure 130. In certain other embodiments, the opening 133 may not extend entirely through the base structure 130 and may merely form an opening in the front surface 131 of the base structure 130 such that the opening forms a socket in the front surface 131 of the base structure 130 rather than a passageway through the base structure 130.

In the exemplified embodiment, the base structure 130 comprises a first pod 134 extending from the front surface 131 of the base structure 130 at a distal end of the head 120 (which is also the distal end 102 of the oral care implement 100) and a second pod 135 extending from the front surface 131 of the base structure 130 at a proximal end of the head 120. The terms first pod 134 and second pod 135, as used generally herein, differentiate between different pods of the oral care implement 100 without any specific location on the head implied. However, in certain embodiments the first pod 134 can be a distal-most pod that is positioned adjacent the proximal end of the head 120 and the second pod 135 can be a proximal-most pod that is positioned adjacent a proximal end of the head 120.

Moreover, although the components extending from the distal and proximal ends of the head 120 are referred to herein as first and second pods 134, 135, the invention is not to be so limited in all embodiments. Thus, in certain embodiments each of the first and second pods 134, 135 can be a protuberance extending upwardly from the front surface 131 of the base structure 130, such as an upstanding wall, a hinge, a strut or the like. In such embodiments, the first pod 134 may be referred to herein as a first protuberance and the second pod 135 may be referred to herein as a second protuberance. The first and second pods 134, 135 are not limited to having a rounded or semi-rounded shape but may be any shaped member extending from the front surface 131 of the base structure 130. Furthermore, although the invention is illustrated and described herein as having a first pod 134 and a second pod 135, in certain embodiments the invention may comprise only one of the pods or only a single protuberance extending upwardly from the front surface 131 of the base structure 130.

The base structure 130 comprises a generally U-shaped cross-section extending longitudinally from the first pod 134 to the second pod 135. This shape of the base structure 130 facilitates movably mounting cleaning elements to the base structure 130 as will be described in more detail below.

Each of the first and second pods 134, 135 are formed integrally with and form a part of the base structure 130. Furthermore, the base structure 130 is formed from a rigid material such as a hard plastic. Thus, each of the first and second pods 134, 135 are substantially non-movable with respect to the base structure 130. Thus, although there is inherent flexibility in all materials, the first and second pods 134, 135 are substantially unable to move relative to the base structure 130 due to their hard plastic material and integral formation.

The base structure 130 of the head 120 of the oral care implement 100 comprises a lateral sidewall 121 that extends between the front and rear surfaces 131, 132 of the base structure 130. The lateral sidewall 121 includes a first side surface 123 and an opposing second side surface 124. The lateral sidewall 121 comprises a waist portion 122 longitudinally positioned in between the first and second pods 134, 135. The waist portion 122 of the lateral sidewall 121 forms a narrowed region of the head 120 between the first and second pods 134, 135. Of course, the invention is not to be particularly limited by the contours and shapes of the base structure 130 in all embodiments unless so specified in the claims. Thus, in certain embodiments the waist portion 122 may be omitted and the base structure 130 can comprise a lateral sidewall having a generally straight, widened and/or rounded shape.

The rear surface 132 of the base structure 130 comprises a basin 136 having a floor 137. The basin 136 is defined by an upstanding wall 138 that extends upwardly from the floor 137 and surrounds the basin 136. The upstanding wall 138 forms a peripheral sidewall of the basin 136.

As will be discussed in more detail below with regard to FIGS. 4 and 5, when the oral care implement 100 is fully assembled a soft tissue cleanser is disposed within the basin 136. The opening 133 formed into the base structure 130 is located within the basin 136 on the rear surface 132 of the base structure 130. More specifically, the base structure 130 comprises an island 140 extending from the floor 137 of the basin 136 and the opening 133 is located within the island 140. The island 140 is formed by a peripheral wall or upstanding sidewall 141 extending upwardly from the floor 137 of the basin 136. The island 140 is an annular, ring-like structure with the opening 133 formed into the center of the island 140. In the exemplified embodiment, the island 140 is formed on the rear surface 132 of the base structure 130 adjacent the narrowed waist portion 122 of the lateral sidewall 121 of the base structure 130 and in between the first and second side surfaces 123, 124 of the lateral sidewall 121. However, the location of the island 140, and hence also the opening 130, can be modified in certain other embodiments.

As noted above, in the exemplified embodiment the head 120 is formed integrally with the handle 110. Thus, in the exemplified embodiment the base structure 130 and the handle 110 are a single, unitary component formed of the hard plastic material, such as polypropylene, polymers and copolymers of ethylene, propylene, butadiene, vinyl compounds and polyesters such as polyethylene terephthalate. However, as noted above in other embodiments the head 120, and hence the base structure 130, can be separately formed from the handle 110 and later attached thereto.

Figure 4A:
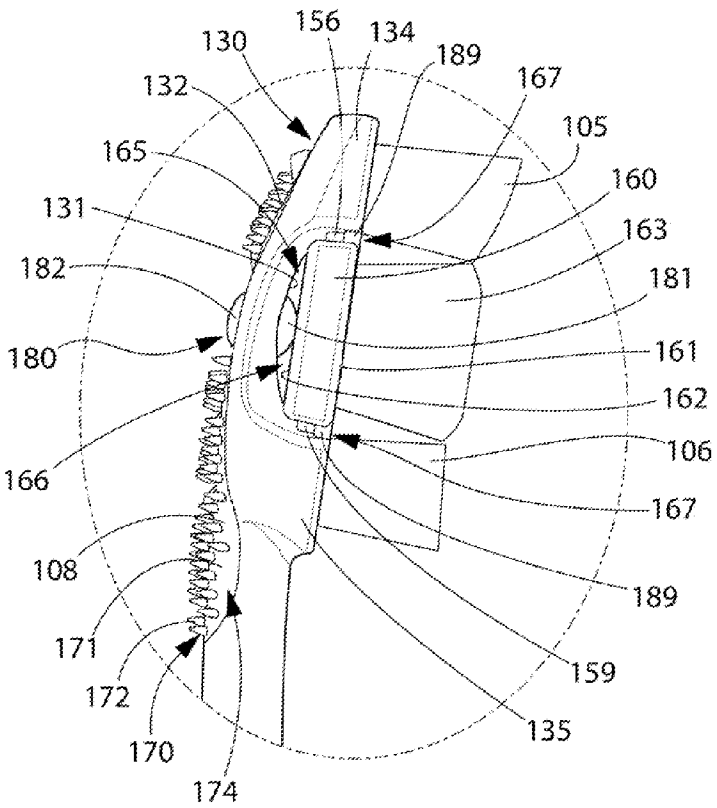
FIG. 4A is a close-up view of area IV-A of FIG. 4.
Figure 4:
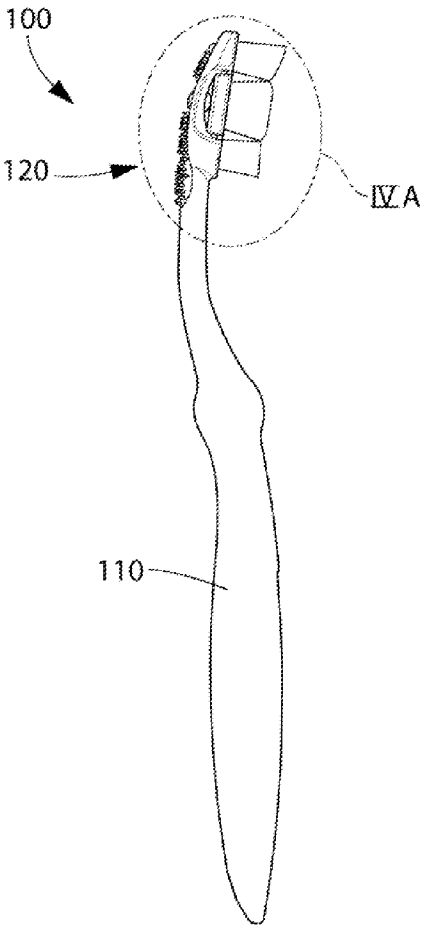
FIG. 4 is a side view of the oral care implement of FIG. 1.
Figure 5A:
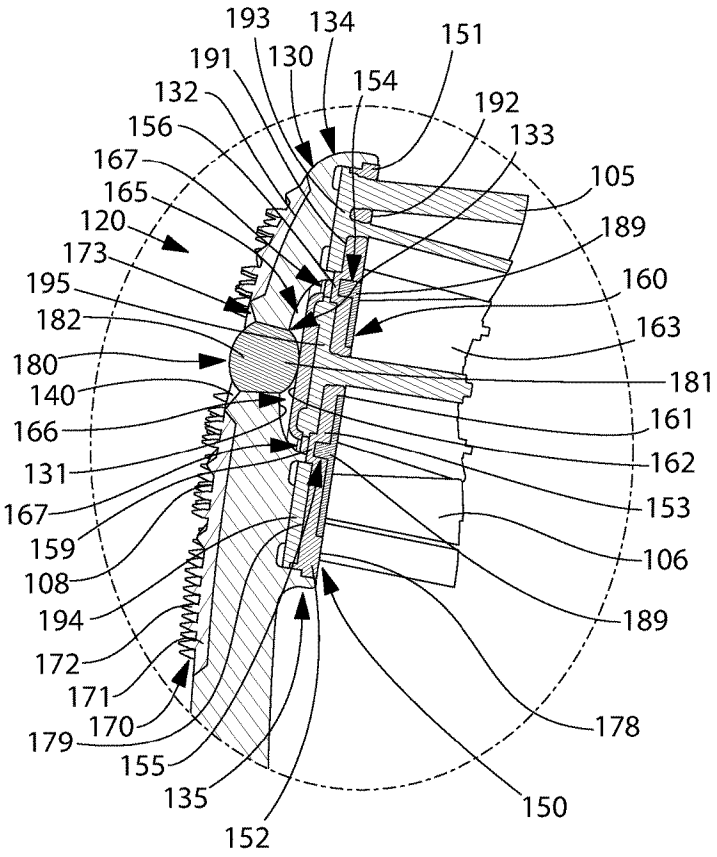
FIG. 5A is a close-up view of area V-A of FIG. 5.
Figure 5:
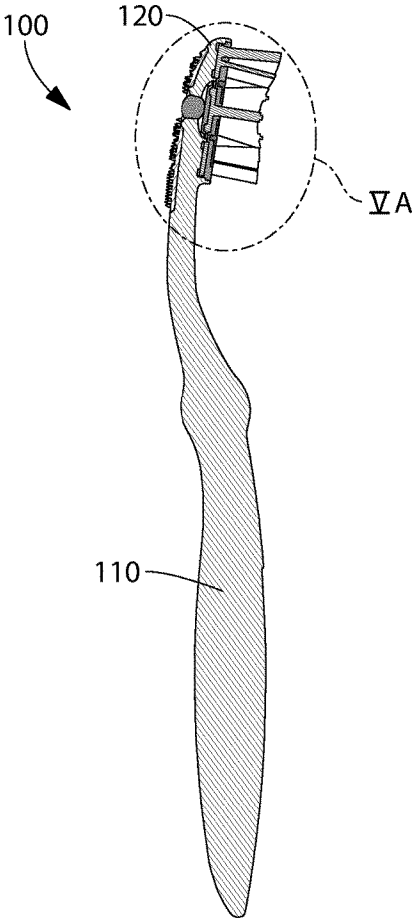
FIG. 5 is a cross-sectional view taken along line V-V of FIG. 1.

Referring to FIGS. 4-5A concurrently, the oral care implement will be further described. The oral care implement 100 comprises a carrier 160 having a front surface 161 and a rear surface 162. The carrier 160 comprises a plurality of tooth cleaning elements 163, which extend from the front surface 161 of the carrier 160. As will be described in more detail below, in certain embodiments a portion of the carrier 160 is formed by a head plate and the tooth cleaning elements 163 are connected to the head plate via an anchor free tufting technique.

The carrier 160 is not directly connected to the base structure 130 of the head 120. Rather, the carrier 160 is supported above the front surface 131 of the base structure 130 such that a gap 165 exists between the rear surface 162 of the carrier 160 and the front surface 131 of the base structure 130. As will be described in detail below, the carrier 160 is supported above the front surface 131 of the base structure 130 in a manner that enables the carrier 160 to be movable in various directions. Thus, the carrier 160 is movably supported above the front surface 131 of the base structure 130. The gap 165 forms a transverse passageway 166 from the first side surface 123 of the base structure 130 of the head 120 to the second side surface 124 of the base structure 130 of the head 120.

In the exemplified embodiment, the carrier 160 is positioned between the first pod 134 and the second pod 135. However, as noted above one of the first or second pods 134, 135 may be omitted in other embodiments such that the carrier 160 is positioned adjacent to only one of the pods 134, 135 and supported thereby in a cantilever manner (FIG. 7). Thus, the carrier 160 is supported above the first surface 131 of the base structure 130 by at least the first pod 134. In the exemplified embodiment, the carrier 160 is supported above the first surface 131 of the base structure 130 by both the first and second pods 134, 135. Specifically, the carrier 160 is supported above the front surface 131 of the base structure 130 by resilient connections 167 to each of the first and second pods 134, 135 such that the carrier 160 is movable relative to the head 120 and base structure 130. The structure that facilitates the resilient connections 167 between the carrier 160 and each of the first and second pods 134, 135 will be described in more detail below with specific reference to FIGS. 5-6.

In addition to the carrier 160 comprising tooth cleaning elements 163 extending therefrom, the first pod 134 comprises a plurality of tooth cleaning elements 105 extending therefrom and the second pod 135 comprises a plurality of tooth cleaning elements 106 extending therefrom. Attachment of the tooth cleaning elements 105, 106 to the first and second pods 134, 135 is achieved via an anchor free tufting technique and will be described in more detail below with reference to FIGS. 5-6.

As discussed above, the rear surface 132 of the base structure 130 comprises a basin 136 formed therein. Furthermore, in the exemplified embodiment the rear surface 132 of the base structure 130 comprises a soft tissue cleanser 170. The soft tissue cleanser 170 comprises a pad portion 171 and a plurality of protuberances 172 protruding from the pad portion 171. The pad portion 171 of the soft tissue cleanser 170 is disposed in the basin 136 and an outer surface 174 of the pad portion 171 of the soft tissue cleanser 170 is flush with the rear surface 132 of the base structure 130 of the head 120. Thus, the tissue cleanser 170 forms a portion of the outer surface of the head 120 of the oral care implement 100. The pad portion 171 of the soft tissue cleanser 170 further includes an opening 173 that surrounds the peripheral wall 141 that forms the island 140. Thus, the soft tissue cleanser 170 is separated and/or isolated from the opening 133 by the island 140, and specifically is formed into the basin 136 via an injection molding technique.

In the exemplified embodiment, each of the plurality of protuberances 172 is in the form of a nub. As used herein a "nub" generally refers to a column-like protrusion (without limitation to the cross-sectional shape of the protrusion) which is upstanding from a base surface. In a general sense, the protuberances 172 in the preferred construction have a height that is greater than the width at the base of the protuberance 172 (as measured in the longest direction). Nevertheless, protuberances or nubs could include projections wherein the widths and heights are roughly the same or wherein the heights are somewhat smaller than the base widths. Moreover, in some circumstances (e.g., where the protuberances tapers to a tip or includes a base portion that narrows to a smaller projection), the base width can be substantially larger than the height.

In one preferred arrangement of the soft tissue cleanser 170, the plurality of protuberances 172 are preferably conically shaped. As used herein, "conically shaped" or "conical" is meant to include true cones, frusto-conically shaped elements, and other shapes that taper to a narrow end and thereby resemble a cone irrespective of whether they are uniform, continuous in their taper, or have rounded cross-sections. In the exemplified embodiment, the soft tissue cleanser 170 including the pad 171 and the protuberances 172 are formed from a resilient material, such as an injection molded thermoplastic elastomer. An example of a suitable elastomeric soft tissue cleaner that may be used with the present invention and positioned on the rear surface 132 of the base structure 130 of the head 120 is disclosed in U.S. Pat. No. 7,143,462, issued Dec. 5, 2006 to the assignee of the present application, the entirety of which is hereby incorporated by reference. In certain other embodiments, the protuberances 172 of the soft tissue cleanser 170 can take the form of elongated ridges, nubs, or combinations thereof.

Still referring to FIGS. 4-5, as discussed above the base structure 130 comprises an opening 133 forming a passageway from the rear surface 132 of the base structure 130 to the front surface 131 of the base structure 130. In the exemplified embodiment, a spheroid 180 is positioned within the opening 133. A first portion 181 of the spheroid 180 protrudes from the front surface 131 of the base structure 130 of the head 120 and into the gap 165 between the rear surface 162 of the carrier 160 and the front surface 131 of the base structure 130. A second portion 182 of the spheroid 180 is visible from the rear surface 132 of the base structure. The second portion 182 of the spheroid protrudes from the rear surface 132 of the base structure 130. In embodiments that comprise an island 140 on the rear surface 132 of the base structure 130, the second portion 182 of the spheroid 180 protrudes from the island 140. Furthermore, in certain embodiments the second portion 182 of the spheroid 180 also protrudes from a rear surface 108 of the head 120 that is formed by the outer surface 174 of the pad 171 of the soft tissue cleanser 170 from which the protuberances 172 protrude.

The spheroid comprises a resilient material. In the exemplified embodiment, the spheroid 180 is entirely formed from the resilient material. Suitable resilient materials for forming the spheroid 180 include injection molded thermoplastic elastomer. However, the invention is not to be so limited in all embodiments and the spheroid 180 can be formed of other resilient materials in certain other embodiments. Furthermore, although the spheroid 180 is illustrated being formed entirely of the resilient material, in certain other embodiments the spheroid may comprise a core that is formed of a rigid material, such as any of the hard plastic materials described herein, and a shell or overmold layer formed of the resilient material. In still other embodiments, the first portion 181 of the spheroid 180 can be formed of a resilient material while the second portion 182 of the spheroid 180 is formed of a rigid material. Other embodiments of the spheroid that achieve the functionality described herein are contemplated. Thus, the spheroid 180 is not limited to being formed entirely of a resilient material in all embodiments.

Furthermore, in the exemplified embodiment the spheroid 180 is illustrated being substantially spherical in shape. However, the invention is not to be so limited in all embodiments and in certain other embodiments the spheroid may take on other spheroid-type shapes, such as for example without limitation an oblate spheroid, a prolate spheroid, an ellipsoid, an ovoid or any par- or truncated versions thereof. Thus, shapes other than those exemplified are contemplated for the spheroid 180 of the present invention. Furthermore, in certain embodiments the spheroid 180 may simply be referred to herein as a mass of resilient material that is positioned within the opening 133. Thus, the spheroid 180 is not to be particularly limited by its shape in all embodiments unless so specified in the claims.

As noted above, the spheroid 180 has a first portion 181 that protrudes from the front surface 131 of the base structure 130 and a second portion 182 that protrudes from the rear surface 132 of the base structure 130. Furthermore, the first portion 181 of the spheroid 180 comprises a first domed surface and the second portion 182 of the spheroid 180 comprises a second domed surface. Thus, each of the first and second portions 181, 182 of the spheroid 180 protrude from their respective surfaces so as to form a dome-shaped surface.

In the exemplified embodiment, the first portion 181 of the spheroid 180 that protrudes from the front surface 131 of the base structure 130 and into the gap 165 is in surface contact with the rear surface 162 of the carrier 160. Of course, the invention is not to be so limited in all embodiments and in certain other embodiments the first portion 181 of the spheroid 180 may protrude into the gap 165 without contacting the rear surface 162 of the carrier 160.

The spheroid 180 alters movement of the carrier 160 relative to the base structure 130 of the head 120 through surface contact with the rear surface 162 of the carrier 160. Specifically, due to being formed at least partially of a resilient material, the spheroid 180 is deformable and/or displaceable within the opening 133. Thus, during brushing the carrier 160 translates in a downward motion directly toward the front surface 131 of the base structure 130 by such deformation and/or displacement of the spheroid 180 relative to the base structure 130. The resilient connection 167 between the carrier 160 and the first and/or second pods 134, 135 facilitates such translational movement of the carrier 160 in response to a brushing force being applied to the carrier 160 in the direction of the front surface 131 of the base structure 130. The force imparted onto the carrier 160 during brushing is sufficient to deform or displace the spheroid 180 to create such a translational movement of the carrier 160 relative to the base structure 130.

Furthermore, due to its shape, and specifically the shape of the first domed surface of the first portion 181 of the spheroid 180, the spheroid 180 acts as a pivot on which the carrier 160 can move. Thus, the carrier 160 can pivot with respect to the base structure 130 about the first portion 181 of the spheroid 180. The direction of pivot of the carrier 160 is in a side-to-side direction transverse to the longitudinal axis A-A. As will be described in more detail below, the resilient connection 167 between the carrier 160 and the first and/or second pods 134, 135 also facilitates the pivoting and translational movements of the carrier 160 relative to the base structure 130.

Both the soft tissue cleanser 170 and the spheroid 180 are formed into or connected to the head 120 via an injection molding step in one embodiment. However, as noted above the soft tissue cleanser 170 is separated or isolated from the opening 133 by the island 140, and hence the soft tissue cleanser 170 is also isolated from the spheroid 180 by the island 140 (and specifically by the peripheral wall 141 of the island 140). Thus, it should be understood that although the spheroid 180 and the soft tissue cleanser 170 are both formed from an injection molding technique, each is made from a separate injection molding shot. Thus, the spheroid 180 and soft tissue cleanser 170 are not unitary or integral, but rather are separate components that are both isolated from one another and separately formed from one another. Furthermore, the soft tissue cleanser 170 and the spheroid 180 may be formed of different materials, such that the spheroid 180 has a greater Shore durometer (e.g., Shore A hardness value) than the soft tissue cleanser 170 or vice versa.

Figure 6:
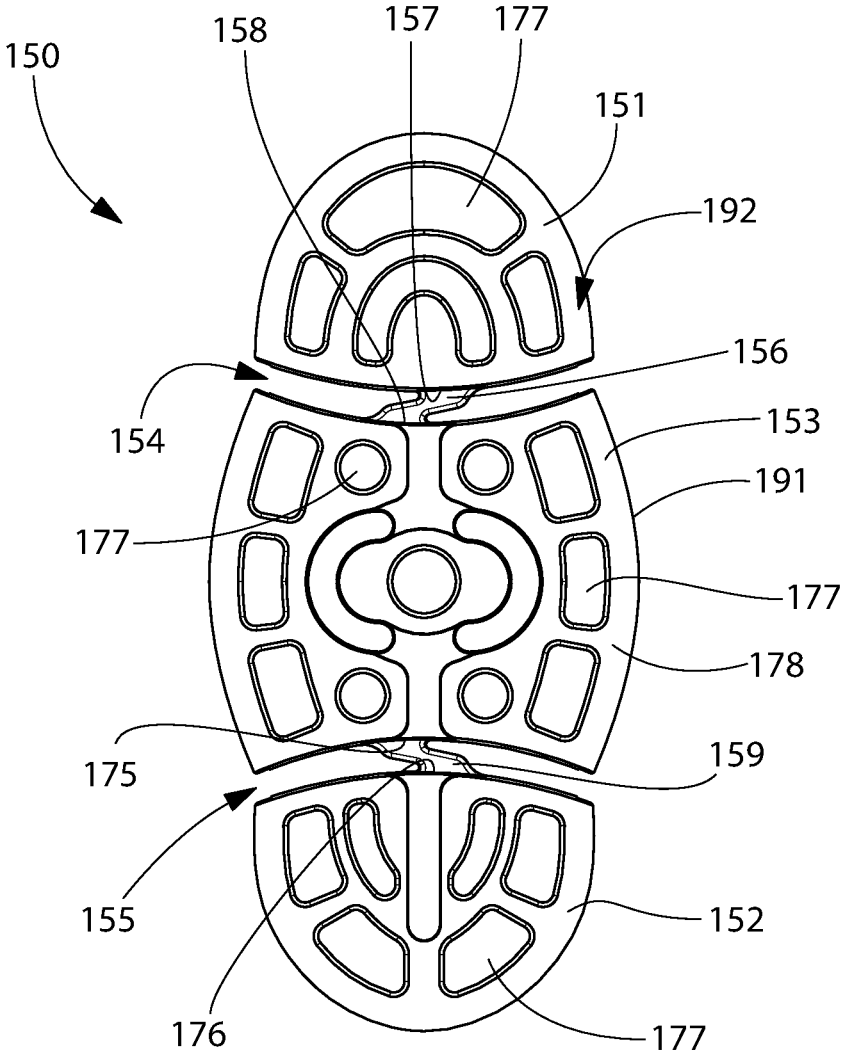
FIG. 6 is a front view of the head plate of the oral care implement of FIG. 1 with the resilient material omitted.
Figure 7:
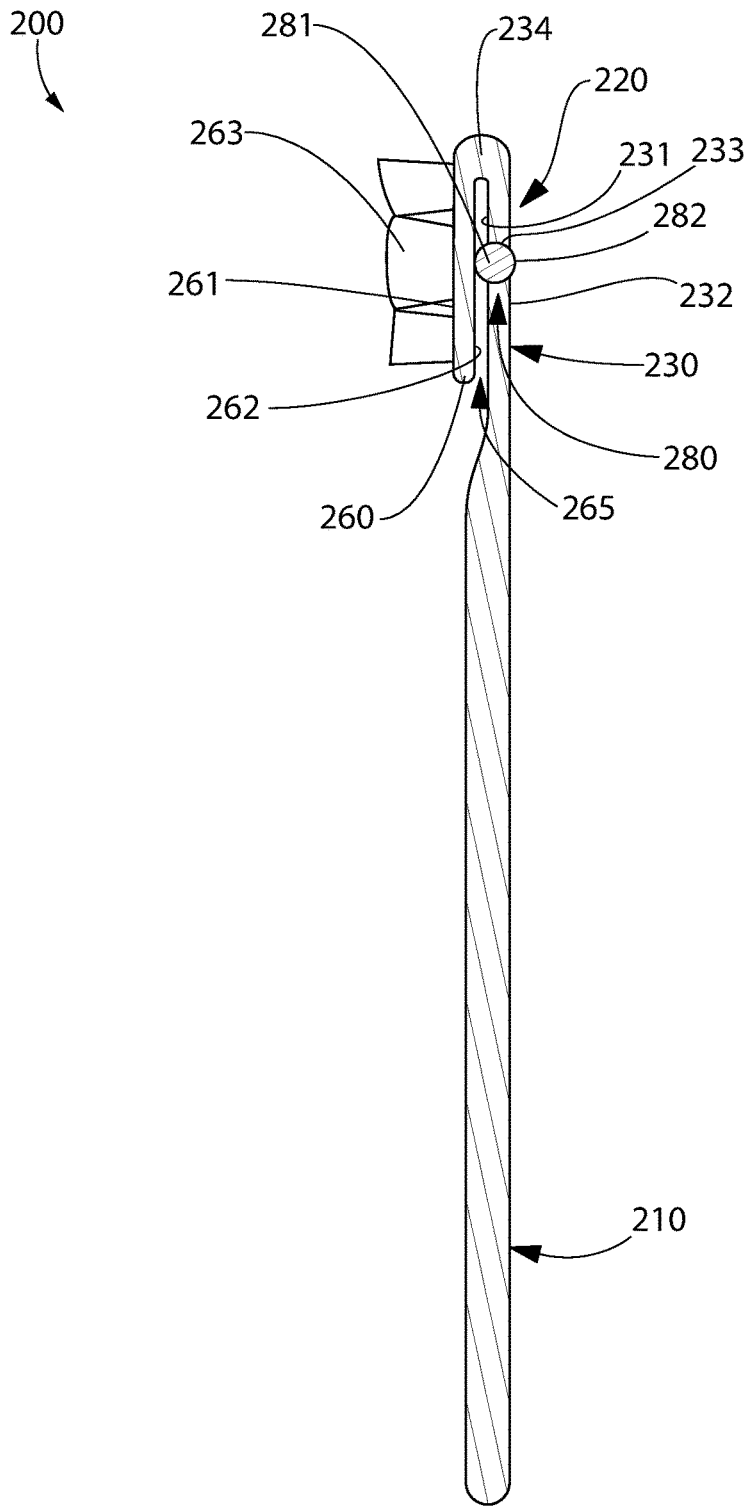
FIG. 7 is a longitudinal cross-sectional view of an oral care implement in accordance with a second embodiment of the present invention.

Referring to FIGS. 5-6A concurrently, a unitary head plate 150 of the oral care implement 100 will be described. As will be described in more detail below, the head plate 150 is used for mounting the tooth cleaning elements via an anchor free tufting technique. After the tooth cleaning elements are mounted to the head plate 150, the head plate 150 is secured to the base structure 130 of the head 120 such as by ultrasonic welding. Of course, the head plate 150 can be secured to the base structure 130 of the head 120 by techniques other than ultrasonic welding, such as for example without limitation thermal welding, a tight-fit assembly, a coupling sleeve, threaded engagement, adhesion, fasteners, a snap-fit or the like.

The unitary head plate 150 generally comprises a first end portion 151, a second end portion 152 and a middle portion 153. A first transverse channel 154 extends between the first end portion 151 and the middle portion 153 forming a gap therebetween. A second transverse channel 155 extends between the second end portion 152 and the middle portion 153 forming a gap therebetween. Furthermore, a first strut 156 extends longitudinally through the first transverse channel 154 from a proximal end 157 of the first end portion 151 to a distal end 158 of the middle portion 153 to connect the first end portion 151 to the middle portion 153. A second strut 159 extends longitudinally through the second transverse channel 155 from a proximal end 175 of the middle portion 153 to a distal end 176 of the second end portion 152 to connect the second end portion 152 to the middle portion 153. Thus, the first and second struts 156, 159 maintain the head plate 150 as a unitary structure that is integrally formed as a single unit despite the gaps formed by the first and second transverse channels 154, 155.

During assembly of the oral care implement 100 after the tooth cleaning elements are connected to the unitary head plate 150, the unitary head plate 150 is coupled to the first and second pods 134, 135 so that the first end portion 151 of the head plate 150 forms a portion of the first pod 134 and the second end portion 152 of the head plate 150 forms a portion of the second pod 135. Furthermore, the middle portion 153 of the head plate 150 forms at least a portion of the carrier 160. In certain embodiments, the middle portion 153 of the head plate 150 forms the entirety of the carrier 160. Thus, the first end portion 151 of the head plate 150 is directly connected to the first pod 134 and the second end portion 152 of the head plate 150 is directly connected to the second pod 135. The middle portion 153 is not directly connected to either the first or second pod 134, 135 or any other portion of the base structure 130, but rather the middle portion 153 is movably and/or flexibly supported above the base structure 130 by the first and second pods 134, 135 (and by the first and second end portions 151, 152 of the head plate 150) as has been described above.

The first and second transverse channels 154, 155 are filled with a resilient material 189. The resilient material 189 is omitted from FIG. 6 so that the first and second struts 156, 159 are visible. The resilient connections between the carrier 160 and the first and second pods 134, 135 described above are formed by a combination of the resilient material 189 that fills in the first and second transverse channels 154, 155 and the first and second struts 156, 159. Thus, the middle portion 153 of the head plate 150 is capable of flexing up-and-down and side-to-side relative to the first and second end portions 151, 152. Similarly, when the head plate 150 is coupled to the first and second pods 134, 135, the resilient material 189 and the first and second struts 156, 159 facilitate the movement of the carrier 160 relative to the base structure 130 (and relative to the first and second pods 134, 135) as has been described herein in detail above.

The unitary head plate 150 comprises a plurality of openings 177 extending from a front surface 178 of the head plate 150 to a rear surface 179 of the head plate 150 (only a select few of the openings 177 are labeled in FIG. 6 to avoid clutter). The tooth cleaning elements 105, 106, 163 are positioned within the openings 177 so that a distal end of the tooth cleaning elements 105, 106, 163 protrudes through a rear surface 191 of the head plate 150 and a major portion of the tooth cleaning elements 105, 106, 163 extends from the front surface 192 of the head plate 150. The portions of the tooth cleaning elements 105, 106, 163 that extend from the front surface 192 of the head plate 150 are used to engage the user's teeth and oral surfaces during use of the toothbrush.

As discussed above, the tooth cleaning elements 105, 106, 163 are connected to the head plate 150 via an anchor free tufting technique. Thus, the distal ends of the tooth cleaning elements 105 of the first pod 134 are melted together by heat to be anchored in place and to form a first melt mat 193. The distal ends of the tooth cleaning elements 106 of the second pod 135 are similarly melted together by heat to be anchored in place and to form a second melt mat 194. Finally, the distal ends of the tooth cleaning elements 163 of the carrier 160 are melted together by heat to be anchored in place and to form a third melt mat 195.

In the exemplified embodiment, the tooth cleaning elements 105, 106, 163 are illustrated as bristles. Common examples of tooth cleaning elements include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Thus, the tooth cleaning elements may include all bristles, a combination of bristles and elastomeric elements, or all elastomeric elements. Suitable elastomeric materials include any biocompatible resilient material suitable for uses in an oral hygiene apparatus. To provide optimum comfort as well as cleaning benefits, the elastomeric material of any tooth or soft tissue engaging elements has a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

Referring to FIG. 7, an oral care implement 200 in accordance with a second embodiment of the present invention will be described. In the interest of brevity, only components of the oral care implement 200 that are different from the oral care implement 100 will be described herein. Furthermore, similar components will be similarly numbered except that the 200-series of numbers will be used.

The oral care implement 200 generally comprises a handle 210 and a head 220. The handle 210 is generically illustrated and can take on any shape, contour or general appearance as desired. The head 220 is connected to the handle 210, and in certain embodiments may be integrally formed with the handle 210. The head 220 and the handle 210 are formed of a rigid material, such as one of the hard plastic materials discussed herein above.

The head 220 comprises a carrier 260 having a front surface 261 and an opposed rear surface 262. A plurality of tooth cleaning elements 263 extend outwardly from the front surface 261 of the carrier 260. Furthermore, the head 220 comprises a base structure 230 having a front surface 231 and an opposed rear surface 232.

The oral care implement 200 further comprises a first pod 234 extending upwardly from the front surface 231 of the base structure 230 of the head 220. The carrier 260 is movably supported above the front surface 231 of the base structure 230 by the first pod 234. In the exemplified embodiment, the carrier 260 is supported above the front surface 231 of the base structure 230 by the first pod 234 in a cantilevered manner. Due to the support of the carrier 260 by the first pod 234, a gap 265 is formed between the rear surface 262 of the carrier 260 and the front surface 231 of the base structure 230.

Furthermore, in the exemplified embodiment the first pod 234 is merely an upstanding wall that extends upwardly from the front surface 231 of the base structure 230. In this manner, the first pod 234 acts as a living hinge that enables the carrier 260 to flex downwardly into the gap 265 in the direction of the base surface 230 in response to a force (i.e., a brushing force) acting on the carrier 260. The invention is not to be limited to the particular structural arrangement of the first pod 234 in all embodiments and in certain other embodiments the first pod 234 can merely be a hinge, a wall or a protuberance having any shape or configuration that is capable of supporting the carrier 260 in a cantilevered manner as illustrated.

In the exemplified embodiment, the connection between the first pod 234 and the carrier 260 is a rigid connection and the first pod 234 and carrier 260 appear to be integrally formed. However, the invention is not to be so limited and the first pod 234 and carrier 260 can be resiliently connected such that a resilient material extends between the first pod 234 and the carrier 260 to achieve the connection between the first pod 234 and the carrier 260 as has been described above with regard to the oral care implement 100.

The base structure 230 comprises an opening 233 that forms a passageway from the front surface 231 of the base structure 230 to the rear surface 232 of the base structure 230. A spheroid 280, such as a mass of resilient material which may be in the shape of a sphere or otherwise as has been discussed herein above with regard to the spheroid 180 of the oral care implement 100, is disposed within the opening 233 so that a first portion 281 of the spheroid 280 protrudes from the front surface 231 of the base structure 230 and a second portion 282 of the spheroid 280 protrudes from the rear surface 232 of the base structure 230.

The spheroid 280 is formed of any of the materials that have been described above for the spheroid 180. Thus, the spheroid 280 is capable of deformation or displacement in response to a brushing force. Therefore, during brushing, when a normal brushing force is applied to the carrier 260, the carrier is translatable toward the front surface 231 of the base structure 230 via the deformation and/or displacement of the spheroid 280 relative to the base structure 230. Furthermore, because the first portion 281 of the spheroid 280 that protrudes from the front surface 231 of the base structure 230 is dome-shaped, the carrier 260 can also pivot with respect to the base structure 230 about the first portion 281 of the spheroid 280 when a normal brushing force is applied to the carrier 260.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the foregoing description and drawings represent the exemplary embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. An oral care implement comprising:

a handle;

a head connected to the handle, the head comprising a base structure having a front surface, a rear surface and an opening forming a passageway extending from the rear surface of the base structure to the front surface of the base structure;

a first pod formed integrally with the base structure and extending from the front surface of the base structure;

a carrier having a front surface and a rear surface, the carrier comprising a plurality of tooth cleaning elements extending from the front surface of the carrier, the carrier movably supported above the front surface of the base structure by at least the first pod so that a gap exists between the rear surface of the carrier and the front surface of the base structure; and a spheroid positioned within the opening so that a first portion of the spheroid protrudes from the front surface of the base structure into the gap and a second portion of the spheroid protrudes from the rear surface of the base structure.

2. The oral care implement according to claim 1 wherein the first portion of the spheroid comprises a first domed surface and the second portion of the spheroid comprises a second domed surface.

3. The oral care implement according to claim 1 wherein the first portion of the spheroid is in surface contact with the rear surface of the carrier.

4. The oral care implement according to claim 1 wherein the spheroid comprises a resilient material and the base structure comprises a rigid material.

5. The oral care implement according to claim 4 wherein the carrier is translatable toward the front surface of the base structure by deformation of the spheroid and/or displacement of the spheroid relative to the base structure in response to a brushing force.

6. The oral care implement according to claim 1 wherein the carrier is pivotable with respect to the base structure about the first portion of the spheroid.

7. The oral care implement according to claim 1 wherein the second portion of the spheroid protrudes from a rear surface of the head.

8. The oral care implement according to claim 1 further comprising a resilient soft tissue cleanser on the rear surface of the base structure.

9. The oral care implement according to claim 8 wherein the resilient soft tissue cleanser comprises a pad portion disposed in a basin formed in the rear surface of the base structure and a plurality of protuberances protruding from the pad portion.

10. The oral care implement according to claim 9 wherein the opening of the base structure is located in an island extending from a floor of the basin.

11. The oral care implement according to claim 1 wherein the carrier is supported by the first pod in a cantilevered manner.

12. The oral care implement according to claim 1 further comprising:

a second pod extending from the front surface of the base structure; and the carrier positioned between the first and second pods and movably supported above the front surface of the base structure by connections to the first and second pods.

13. The oral care implement according to claim 12 wherein the first and second pods are substantially non-movable with respect to the base structure.

14. The oral care implement according to claim 12 wherein each of the first and second pods comprise a plurality of teeth cleaning elements extending therefrom.

15. The oral care implement according to claim 14 further comprising:

a unitary head plate comprising a first end portion, a second end portion, and a middle portion connected to the first and second end portion by the connections;

the plurality of teeth cleaning elements of the first and second pods and the carrier coupled to the head plate; and the head plate coupled to the first and second pods so that the first end portion of the head plate forms a portion of the first pod and the second end portion of the head plate forms a portion of the second pod, the middle portion of the head plate forming a portion of the carrier.

16. The oral care implement according to claim 1 wherein the gap forms a transverse passageway from a first side surface of the head to a second side surface of the head.

17. An oral care implement comprising:

a handle;

a head connected to the handle, the head comprising a base structure having a front surface, a rear surface and an opening forming a passageway extending from the rear surface of the base structure to the front surface of the base structure;

a first protuberance formed integrally with the base structure and extending from the base structure;

a carrier having a front surface and a rear surface, the carrier comprising a plurality of teeth cleaning elements extending from the front surface of the carrier, the carrier movably supported above the front surface of the base structure by the first protuberance so that a gap exists between the rear surface of the carrier and the front surface of the base structure; and a spheroid positioned within the opening so that a first portion of the spheroid protrudes from the front surface of the base structure into the gap.

18. The oral care implement of claim 17 wherein the first protuberance extends from the front surface of the base structure.

19. The oral care implement of claim 18 wherein the carrier is supported by the first protuberance in a cantilevered manner.

20. The oral care implement according to claim 17 further comprising:

a second protuberance extending from the front surface of the base structure; and the carrier positioned between the first and second protuberances and movably supported above the front surface of the base structure by connections to the first and second protuberances.

21. The oral care implement according to claim 17 wherein the spheroid comprises a resilient material and the base structure comprises a rigid material.

22. The oral care implement according to claim 21 wherein the carrier is translatable toward the front surface of the base structure by deformation of the spheroid and/or displacement of the spheroid relative to the base structure in response to a brushing force.

23. The oral care implement according to claim 17 wherein the carrier is pivotable with respect to the base structure about the first portion of the spheroid.

24. An oral care implement comprising:

a handle;

a head connected to the handle, the head comprising a base structure having a front surface and an opening in the front surface;

a first protuberance extending from the base structure;

a carrier having a front surface and a rear surface, the carrier comprising a plurality of teeth cleaning elements extending from the front surface of the carrier, the carrier movably supported above the front surface of the base structure by the first protuberance so that a gap exists between the rear surface of the carrier and the front surface of the base structure; and a spheroid positioned within the opening so that a first portion of the spheroid protrudes from the front surface of the base structure into the gap, wherein the first portion of the spheroid is in surface contact with the rear surface of the carrier when a force is applied to the carrier in the direction of the front surface of the base structure.

* * * * *